United States Patent [19]

Coy

[11] Patent Number: 5,062,531

[45] Date of Patent: Nov. 5, 1991

[54] MEDICINE CADDY OR TRAY

[76] Inventor: Walter G. Coy, 36652 Six Mile Rd., Livonia, Mich. 48152

[21] Appl. No.: 325,949

[22] Filed: Mar. 20, 1989

[51] Int. Cl.[5] ..... B65D 1/36

[52] U.S. Cl. ..... 206/564; 206/814; 206/815; 206/557

[58] Field of Search ..... 206/538, 539, 557, 558, 206/562, 563, 564, 814, 815

[56] References Cited

U.S. PATENT DOCUMENTS

| | | | |
|---|---|---|---|
| 2,766,919 | 10/1956 | Randall | 206/562 |
| 4,195,734 | 4/1980 | Boner et al. | 206/562 |
| 4,444,310 | 4/1984 | Odell | 206/815 |
| 4,584,466 | 4/1986 | de Mola | 219/386 |
| 4,662,676 | 5/1987 | Havelock | 297/194 |

*Primary Examiner*—Paul T. Sewell
*Assistant Examiner*—Jacob K. Ackun, Jr.
*Attorney, Agent, or Firm*—Gifford, Groh, Sprinkle, Patmore and Anderson

[57] ABSTRACT

A medicine caddy or medicine tray includes a body having a number of medicine container holding recesses defined on the top side of the body. The recesses have inner diameters of different sizes. The body is composed of a light weight and inexpensive material, preferably a plastic. One of the recesses is a corner recess. This corner recess is provided for implacement of the index finger. While the thumb and second finger pinch the corner of the body, the tray can thus be carried. One or more concentric rings are removably provided to accommodate different-sized medicine containers.

6 Claims, 1 Drawing Sheet

MEDICINE CADDY OR TRAY

BACKGROUND OF THE INVENTION

I. Field of the Invention

The present invention relates generally to medicine holders. More particularly, the present invention relates to a medicine holder having a body with a number of recesses defined in its top side for removably receiving medicine holders and containers.

II. Description of the Relevant Art

The use of medicines and pills has often proved an inconvenience, particularly when a patient is being administered more than one type of medicine or pill. Common is the scene of a crowded and overflowing medicine chest where shelf upon shelf is overlaiden with required drugs. Such a sight of disorderliness only increases the anxiety of the patient.

Often times laying the required medications out on a table or countertop does little to alleviate the aggravating condition. This situation is particularly distressing for the elderly patient who struggles to maintain his independence and would like to find some way to organize his entourage of pill bottles so as to make his life more enjoyable. One way of accomplishing this is to organize his pills in a safe and orderly fashion. Safe so that no needed medication is overlooked. Orderly so that the pills may be organized, but not hidden or misplaced.

Accordingly, inventors have in the past endeavored to provide pill organizers of different types. A good example of such a pill organizer is found in U.S. Pat. No. 3,744,672 issued in 1973 to Dangles et al. The container of Dangles offers pill organization, but requires that the pills be pre-divided and organized long before use. The same is true for the organizer disclosed in U.S. Pat. No. 4,473,156 issued in 1984 to Martin. In both instances the pills are organized. In both instances the pills are first withdrawn from their containers prior to organization thereof. This may be suitable when the patient is being cared for by another person, but is hardly convenient when the person lives by himself. In any event, neither of these organizers can accomodate liquid medicines, thus limiting their utility.

Accordingly, the prior approach to pill and medicine organizers failed to eliminate the inconvenience of organizing and taking pills.

SUMMARY OF THE PRESENT INVENTION

The present invention provides a medicine caddy or medicine container which is easy to use and inexpensive to manufacture.

The medicine caddy according to the present invention comprises a body composed of a light weight material such as a rigid plastic or an expanded, flexible plastic or other resilient, easy-to-manufacture material. The body is preferably approximately 15 centimeters by 15 centimeters and is about 4 centimeters deep. The body includes a top, a bottom and at least three, but preferably four, sides.

The top side has defined therein a number of recesses for removably accomodating medicine containers. Because of the resilience of the body, a medicine container is held firmly in place in its respective recess. The inner diameters of the recesses should be different from one another to thereby accomodate containers of different sizes. The recesses should be defined about half of the way through the depth of the body.

To alter the size of a given recess, one or more removable concentric adjustment rings are provided to thereby improve the universality of the caddy or tray. The rings should be composed of a material similar to the material of the body.

For easy grasping of the caddy or tray, an aperture is provided at a corner of the tray for emplacement of the index finger of the user. By the user thereafter pinching the corner of the tray between his thumb and his second finger and with the index finger in place, the tray may easily be lifted from a flat surface such as a table or countertop.

The above and other objects, advantages and features of the present invention will become more apparent from the following detailed description when read in conjunction with the accompanying drawing.

DETAILED DESCRIPTION OF THE DRAWING

The various features, advantages and other uses of the present invention will become more apparent by referring to the following detailed description and drawing in which.

DETAILED DESCRIPTION OF THE PREFERRED EMBODIMENT OF THE PRESENT INVENTION

Figure 1:
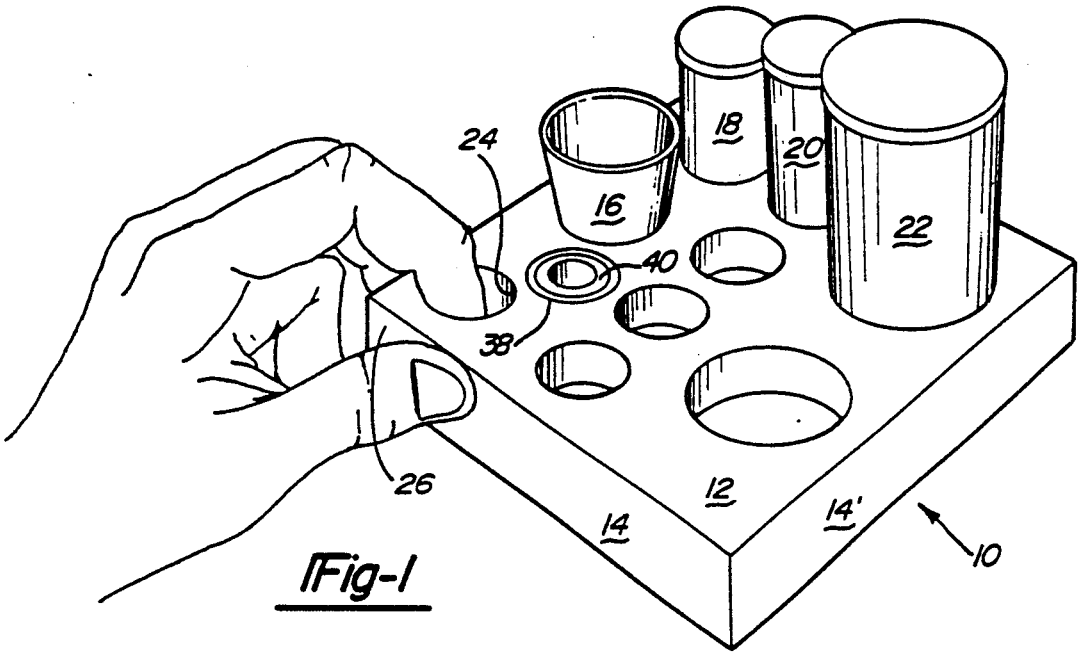
FIG. 1 is a perspective view of a medicine caddy or tray according to the present invention wherein there are a number of medicine containers in place in the caddy and the caddy is being properly supported by the user.

The drawing discloses a preferred embodiment of the present invention. While the configuration according to the illustrated embodiment is preferred, it is envisioned that alternate configurations of the present invention may be adopted without deviating from the invention as portrayed. The preferred embodiment is discussed hereafter.

With reference to FIG. 1, a medicine caddy or tray according to the present invention is shown, generally indicated by 10. The tray 10 includes a top 12 and a number of sides of which two sides 14, 14' can be seen. The tray 10 is illustrated as holding a number of medicine containers 16, 18, 20, 22 of different sizes. The containers 18, 20, 22 conventionally include covers 19, 21, 23 respectively. The containers 16, 18, 20, 22 are removably fitted into any of a number of recesses defined in the top 12 of the tray 10. The recesses are described fully with respect to FIG. 2.

Still with respect to FIG. 1, the material of choice for construction is of light weight and preferably is a polymerized material such as a rigid plastic. Such construction would provide a tray that is light and is easy to maneuver and carry. This construction offers a hygienic advantage in that the tray 10 could be readily sanitized with soap and water.

As an alternate embodiment, instead of a rigid plastic, an expanded, flexible foam plastic could be employed in construction of the tray 10. This construction would provide for the containers being firmly but removably held.

As illustrated in FIG. 1, the tray 10 has four sides, two of which, sides 14, 14', may be seen. Naturally, less than four sides or more than four sides may be presented in the construction.

FIG. 1 also illustrates the tray 10 being held in a user's hand. The illustrated way of grasping is preferred to facilitate easy lifting from a planar surface such as a table or counter and for easy replacement thereon. According to this grip, the tip of the index finger is positioned into a holding aperture 24 defined in the top 12 of the tray 10. Thereafter, the corner area, generally indicated by 26, is pinched between the user's thumb and second finger, thus facilitating easy lifting, carrying and resting of the tray 10.

Figure 2:
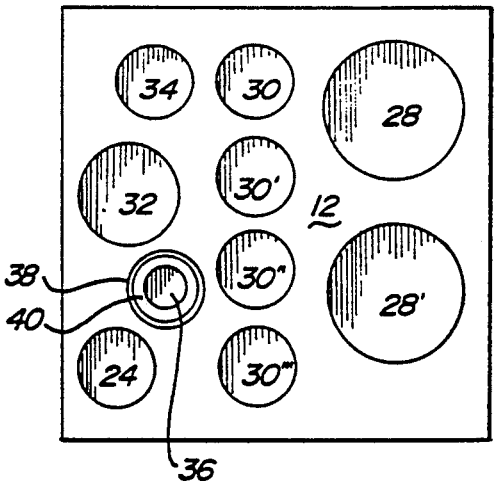
FIG. 2 is a top plan view of the caddy or tray of FIG. 1 illustrating the placement of the recesses.

With reference to FIG. 2, a top plan view of the tray 10 is illustrated to reveal the suggested placement and sizing of the container-holding recesses. Naturally, the illustrated construction is only suggested, and the number, size and placement of the recesses may be varied. (However, the placement of the holding aperture 24 should always be by a corner, and its size should be large enough to accomodate the tip of a user's index finger.)

The suggested recesses include a pair of large recesses 28, 28', four small recesses 30, 30', 30'', 30''', and two intermediate recesses 32, 34. One or more of the recesses may be dedicated for size one (1) ounce multiple medicine cups for oral intake of liquid medicine or pills. For example, the recess 32 may be dedicated for such purpose.

The recesses can be of different depths, extending to a bottom surface 33 but should be of sufficient depth so as to firmly hold a container. However, the recesses should not be so deep so as to weaken the integrity of the tray 10. Accordingly, a depth of approximately one-half the depth of the tray 10 is suggested.

One of the recesses, a sample ring recess 36, is selected to illustrate a method by which the tray 10 may be modified to accomodate containers of different sizes, and may also be used to hold vials, thermometers and the like. This method of construction is more clearly shown with respect to FIG. 3.

Figure 3:
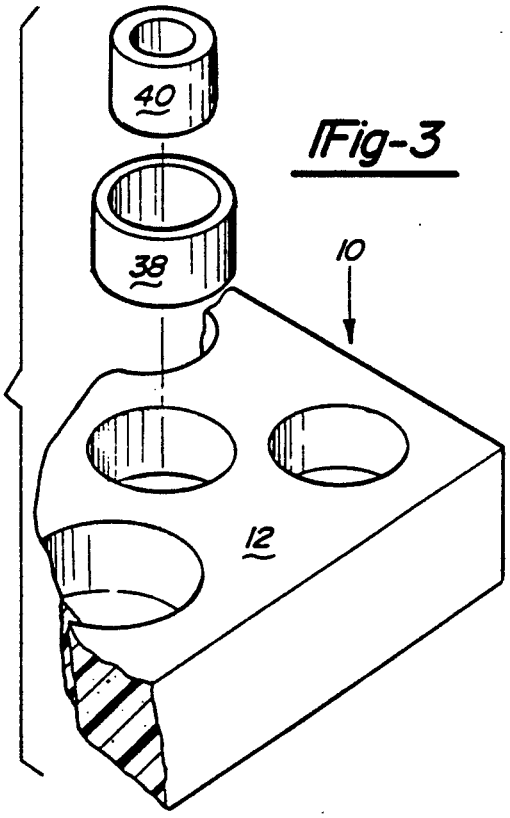
FIG. 3 is a partial perspective exploded view of the caddy and two concentric adjustment rings.

With reference to FIG. 3, a partial tray 10 is shown. Exploded to better illustrate the assembly, FIG. 3 also includes a large concentric reducing ring 38 and a small concentric reducing ring 40. As best shown in FIG. 1, the rings 38, 40, when fitted into place, have a top surface substantially flush with the top surface of the tray. Naturally, the inner and outer diameters of the rings 38, 40 may be varied so as to be fittable within recesses of different sizes or within other rings. And, if preferred, one ring (not illustrated) may take the place of the two suggested rings 38, 40. The object here is to provide a method by which the recesses of the tray 10 may be modified for resiliently receiving containers of different sizes, thereby expanding significantly the utility of the tray 10. Preferably, the rings 38, 40 are of the same material as the tray 10. The rings 38, 40 may be cut to selected lengths from plastic tubing.

Having described my invention, however, many modifications thereto will become apparent to those skilled in the art to which it pertains without deviation from the spirit of the invention as defined by the scope of the appended claims.

I claim:

1. A tray for removably holding one or more medicine containers, said tray comprising:

a body having a plurality of medicine-container holding recesses defined therein, said body including at least three sides, a substantially planar base, and a substantially planar top, said recesses being defined in said top;

said body being composed of a lightweight, resiliently flexible and expanded polymerized material, whereby said one or more medicine containers may be firmly but removably held;

means for altering the inner diameter of at least one of said plurality of said recesses, said means for altering the inner diameter comprising at least one selectively removable and reinsertable concentric sizing ring having a diameter smaller than the diameter of said one of said plurality of recesses, said at least one ring being adapted to be received in said one of said plurality of recesses, said at least one ring being tubular and cylindrical in shape and having an axial length substantially the same as depth of said recess so that, upon insertion of said ring into said recess, a top surface of said at least one ring is substantially flush with a top surface of said body;

said means for altering being composed of a lightweight, resiliently flexible and expanded polymerized material, whereby said one or more medicine containers may be firmly but removably held;

said at least one sizing ring being firmly but removably held in said body;

means for grasping, said means for grasping comprising an aperture defined in said top for receiving an index finger when two of said at least three sides are pinched between the thumb and the second finger of a user's hand.

2. A tray according to claim 1 for removably holding one ore more medicine containers, said tray comprising a body, said body having a plurality of medicine-container holding recesses defined therein, said recesses being defined approximately one-half of the way through said body.

3. A tray according to claim 2, wherein said body includes at least three sides, a substantially planar base, and a substantially planar top, said recesses being defined in said top.

4. A tray according to claim 2, wherein said recesses have variously-sized inner diameters.

5. A tray according to claim 3, further including means for grasping.

6. The invention as defined in claim 1 wherein said at least one ring comprises two rings wherein one of said rings is dimensioned to be received within the interior of the other ring.

* * * * *